US009435212B2

(12) United States Patent
Scribner et al.

(10) Patent No.: US 9,435,212 B2
(45) Date of Patent: Sep. 6, 2016

(54) TURBINE AIRFOIL WITH LATERALLY EXTENDING SNUBBER HAVING INTERNAL COOLING SYSTEM

(71) Applicant: Siemens Energy, Inc., Orlando, FL (US)

(72) Inventors: Carmen Andrew Scribner, Charlotte, NC (US); Stephen John Messmann, Charlotte, NC (US); Jan H. Marsh, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 428 days.

(21) Appl. No.: 14/074,930

(22) Filed: Nov. 8, 2013

(65) Prior Publication Data

US 2015/0132147 A1 May 14, 2015

(51) Int. Cl.

*F01D 5/18* (2006.01)
*F01D 5/22* (2006.01)
*F01D 5/30* (2006.01)

(52) U.S. Cl.

CPC ..... *F01D 5/188* (2013.01); *F01D 5/187* (2013.01); *F01D 5/22* (2013.01); *F01D 5/3007* (2013.01); *F05D 2260/201* (2013.01)

(58) Field of Classification Search

CPC ..... F01D 5/22
See application file for complete search history.

(56) References Cited

U.S. PATENT DOCUMENTS

| | | | | |
|---|---|---|---|---|
| 5,493,855 | A * | 2/1996 | Walters | F01D 5/187 415/173.1 |
| 7,201,564 | B2 * | 4/2007 | Bolms | F01D 5/189 415/115 |
| 2011/0079021 | A1 * | 4/2011 | Maldonado | F01D 9/041 60/806 |
| 2011/0194939 | A1 | 8/2011 | Marra | |
| 2011/0194943 | A1 | 8/2011 | Mayer et al. | |
| 2012/0027616 | A1 | 2/2012 | Merrill et al. | |

FOREIGN PATENT DOCUMENTS

| | | |
|---|---|---|
| EP | 0036044 A1 | 9/1981 |

* cited by examiner

*Primary Examiner* — Craig Kim
*Assistant Examiner* — Brian O Peters

(57) ABSTRACT

A turbine airfoil usable in a turbine engine and having at least one snubber with a snubber cooling system positioned therein and in communication with an airfoil cooling system is disclosed. The snubber may extend from the outer housing of the airfoil toward an adjacent turbine airfoil positioned within a row of airfoils. The snubber cooling system may include an inner cooling channel separated from an outer cooling channel by an inner wall. The inner wall may include a plurality of impingement cooling orifices that direct impingement fluid against an outer wall defining the outer cooling channel. In one embodiment, the cooling fluids may be exhausted from the snubber, and in another embodiment, the cooling fluids may be returned to the airfoil cooling system. Flow guides may be positioned in the outer cooling channel, which may reduce cross-flow by the impingement orifices, thereby increasing effectiveness.

18 Claims, 5 Drawing Sheets

TURBINE AIRFOIL WITH LATERALLY EXTENDING SNUBBER HAVING INTERNAL COOLING SYSTEM

STATEMENT REGARDING FEDERALLY SPONSORED RESEARCH OR DEVELOPMENT

Development of this invention was supported in part by the United States Department of Energy, Advanced Turbine Development Program, Contract No. DE-FC26-05NT42644. Accordingly, the United States Government may have certain rights in this invention.

FIELD OF THE INVENTION

This invention is directed generally to turbine airfoils, and more particularly to hollow turbine airfoils having cooling channels for passing fluids, such as air, to cool the airfoils.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine vane and blade assemblies to these high temperatures. As a result, turbine vanes and blades must be made of materials capable of withstanding such high temperatures. In addition, turbine vanes and blades often contain cooling systems for prolonging the life of the vanes and blades and reducing the likelihood of failure as a result of excessive temperatures.

Typically, turbine blades are formed from an elongated portion forming a blade having one end configured to be coupled to a turbine blade carrier and an opposite end configured to form a blade tip. The blade is ordinarily composed of a leading edge, a trailing edge, a suction side, and a pressure side. The inner aspects of most turbine blades typically contain an intricate maze of cooling circuits forming a cooling system. The cooling circuits in the blades receive air from the compressor of the turbine engine and pass the air through the ends of the blade adapted to be coupled to the blade carrier. The cooling circuits often include multiple flow paths that are designed to maintain all aspects of the turbine blade at a relatively uniform temperature. At least some of the air passing through these cooling circuits is exhausted through orifices in the leading edge, trailing edge, suction side, and pressure side of the blade. Cooling circuits have also been included within snubbers. While advances have been made in the cooling systems in turbine blades, a need still exists for a turbine blade having increased cooling efficiency for dissipating heat while passing a sufficient amount of cooling air through the blade and attached snubber and demanding as little energy as possible from the turbine engine in the form of compressed air.

SUMMARY OF THE INVENTION

A turbine airfoil usable in a turbine engine and having one or more snubbers with a snubber cooling system positioned therein and in communication with an airfoil cooling system is disclosed. The snubber may extend from an outer housing of the airfoil toward an adjacent turbine airfoil positioned within a row of airfoils. The snubber cooling system may include an inner cooling channel separated from an outer cooling channel by an inner wall. The inner wall may include a plurality of impingement cooling orifices that direct impingement fluid against an outer wall defining the outer cooling channel and snubber outer wall. In one embodiment, the cooling fluids may be exhausted from the snubber, and in another embodiment, the cooling fluids may be returned to the airfoil cooling system for additional use. Flow guides may be positioned in the outer cooling channel, which may reduce cross-flow by the impingement cooling orifices, thereby increasing effectiveness.

The turbine airfoil may include a generally elongated hollow airfoil formed from an outer housing, and having a leading edge, a trailing edge, a pressure side, a suction side, a root at a first end of the airfoil and a tip at a second end opposite to the first end, and an airfoil cooling system positioned within interior aspects of the generally elongated hollow airfoil. The turbine airfoil may also include a snubber extending from the outer housing forming the generally elongated hollow airfoil toward an adjacent turbine airfoil positioned within a row of airfoils including the generally elongated hollow airfoil. A snubber cooling system may be positioned within the snubber and may be formed from one or more inner cooling channels separated from one or more outer cooling channels by an inner wall. The inner cooling channel may be in fluid communication with the airfoil cooling system via an inlet to receive cooling fluid from the airfoil cooling system within the generally elongated hollow airfoil. The inner wall may include one or more impingement cooling orifices positioned to allow cooling fluid to pass from the inner cooling channel and impinge on an inner surface of an outer wall forming the outer cooling channel.

The outer wall forming the outer cooling channel may include one or more cooling fluid discharge orifices for discharging cooling fluid. The cooling fluid discharge orifice may include a plurality of cooling fluid discharge orifices aligned in rows separated laterally along a longitudinal axis of the snubber. The inner wall may be formed from an insert positioned within the outer wall. The inner wall may include an end cap that is sealed to the outer wall to enclose the snubber cooling system. The inner and outer walls may be cylindrical, and the inner wall may be positioned concentrically within the outer wall. In other embodiments, the inner and outer walls may have other shapes.

In another embodiment, a cooling fluid exhaust channel formed from an exhaust wall may be positioned within the snubber cooling system and may have an outlet in fluid communication with the airfoil cooling system to return the cooling fluid to the airfoil cooling system. A cooling fluid manifold may be positioned between the outer cooling channel and the cooling fluid exhaust channel. More specifically, the cooling fluid manifold may be positioned at an inner surface of an end cap. The cooling fluid exhaust channel may be positioned within the inner cooling channel. In particular, the exhaust, inner and outer walls may be cylindrical. The inner wall may be positioned concentrically within the outer wall, and the exhaust wall may be positioned concentrically within the inner wall. The inner wall and the exhaust wall may be formed from an insert positioned within the outer wall, and the insert may include an end cap that is sealed to the outer wall to enclose the snubber cooling system.

A plurality of flow guides may extend radially outward from the inner wall into the outer cooling channel to reduce cross-flow at downstream impingement orifices. The impingement cooling orifices in the inner wall may be positioned between two flow guides, and exhaust orifices in an end wall leading to a cooling fluid manifold may be circumferentially offset, one each direction, from a mini-chamber created by the two flow guides so that impingement cooling fluid exhausted through the impingement cooling orifices must pass one of the flow guides to exit from the outer cooling channel through the exhaust orifices, thereby reducing cross-flow across downstream impingement cooling orifices.

An advantage of the snubber cooling system is that the snubber cooling system includes impingement cooling in that cooling fluid from the airfoil cooling system may be passed through impingement orifices and impinge on an inner surface of the outer wall forming the outer cooling channel within the snubber.

Another advantage of the snubber cooling system is that the snubber cooling system may receive cooling fluid from the airfoil cooling system, pass the cooling fluid through the snubber cooling system, and exhaust the cooling fluid back into the airfoil cooling system rather than exhausting the cooling fluid from the snubber and the airfoil.

Yet another advantage of the snubber cooling system is that the snubber cooling system may include flow guides that entrain and isolate cooling fluids from downstream impingement orifices, thereby reducing cross-flow across downstream impingement orifices which increases the effectiveness of the downstream impingement orifices.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 6:
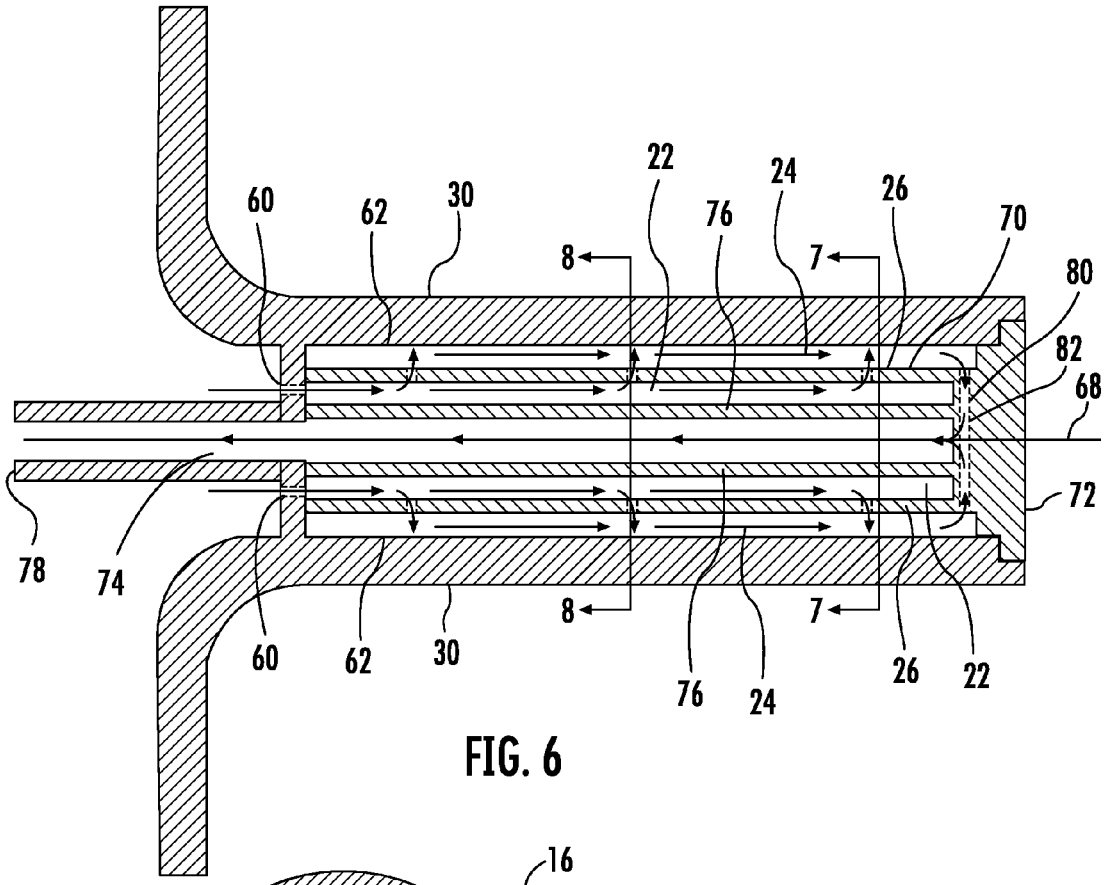
FIG. 6 is a cross-sectional view of another embodiment of the snubber extending outwardly from the turbine airfoil and showing a snubber cooling system with an exhaust channel returning cooling fluid from the snubber cooling system to the airfoil cooling system, taken at section line 4-4 in FIG. 3.
Figure 7:
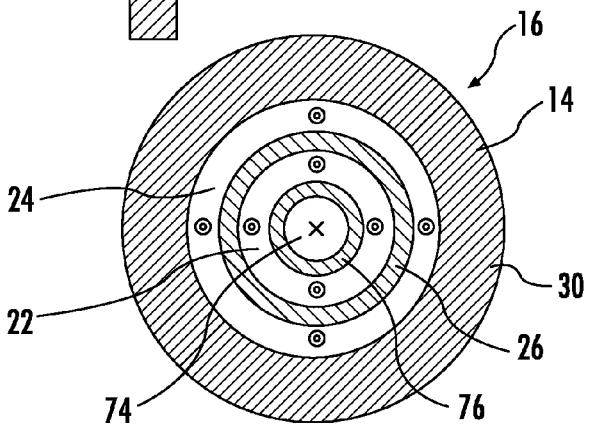
FIG. 7 is a cross-sectional view of the snubber extending outwardly from the turbine airfoil, taken at section line 7-7 in FIG. 6.
Figure 8:
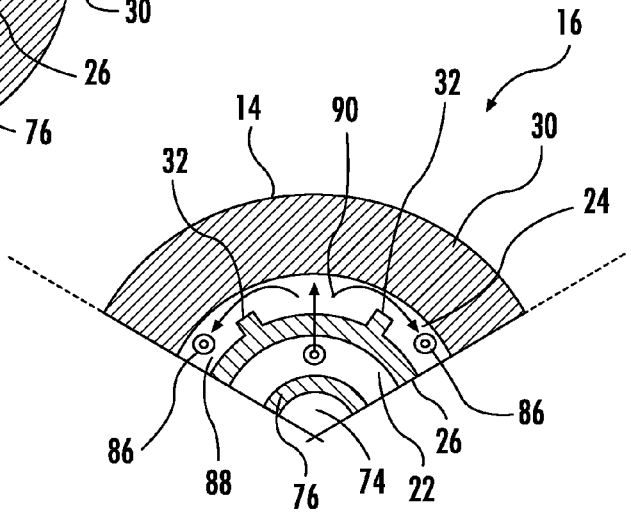
FIG. 8 is a partial cross-sectional view of the snubber extending outwardly from the turbine airfoil and including flow guides, taken at section line 8-8 in FIG. 6.

As shown in FIGS. 1-8, a turbine airfoil 10 usable in a turbine engine 12 and having one or more snubbers 14 with a snubber cooling system 16 positioned therein and in communication with an airfoil cooling system 18 is disclosed. The snubber 14 may extend from an outer housing 20 of the airfoil 10 toward an adjacent turbine airfoil 10 positioned within a row 58 of airfoils 10. The snubber cooling system 16 may include an inner cooling channel 22 separated from an outer cooling channel 24 by an inner wall 26. The inner wall 26 may include a plurality of impingement cooling orifices 28 that direct impingement fluid against an outer wall 30 defining the outer cooling channel 24 and snubber outer wall. In one embodiment, the cooling fluids may be exhausted from the snubber 14, and in another embodiment, the cooling fluids may be returned to the airfoil cooling system 18 for additional use. As shown in FIG. 8, flow guides 32 may be positioned in the outer cooling channel 24, which may reduce cross-flow by the impingement cooling orifices 28, thereby increasing effectiveness.

Figure 1:
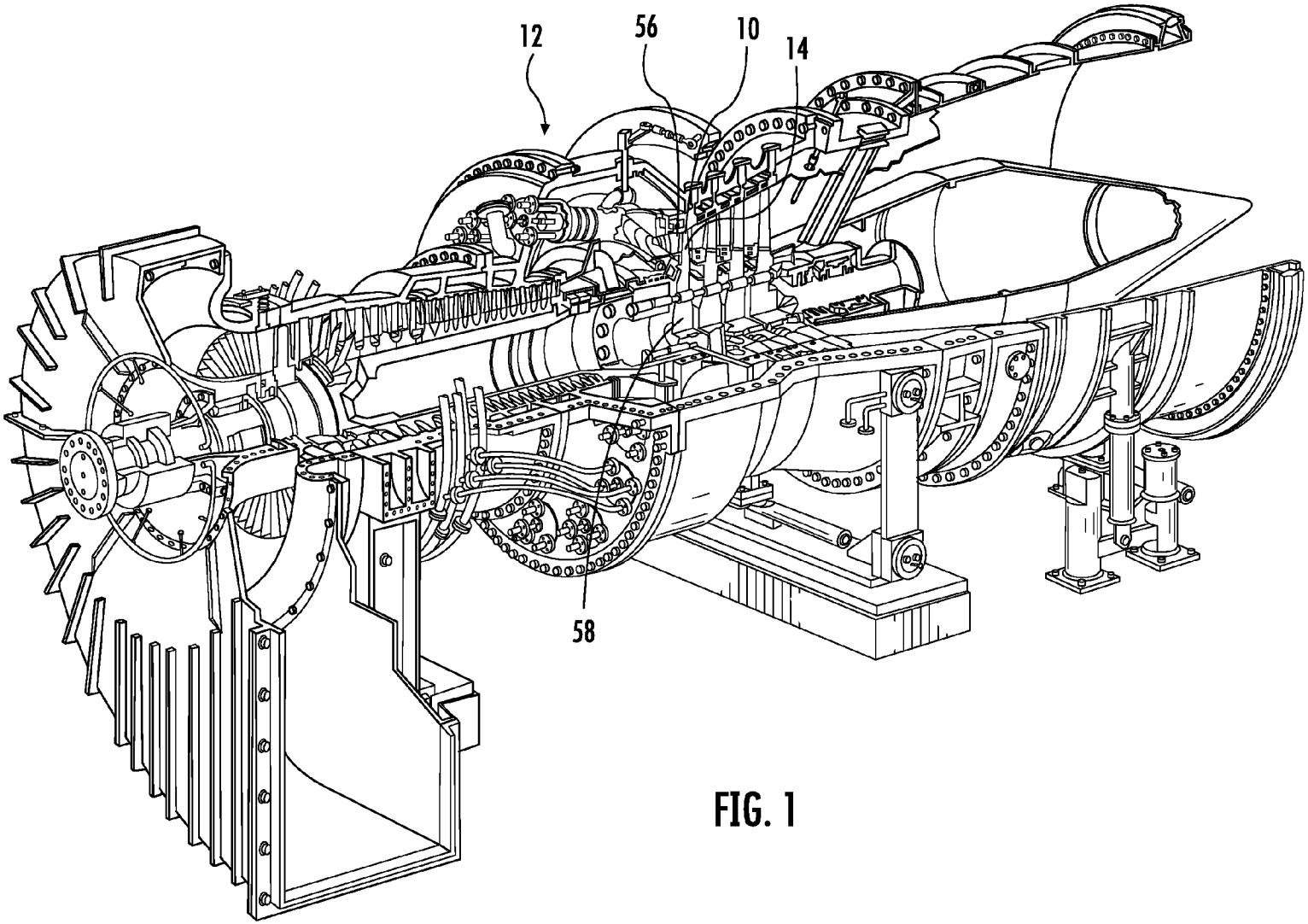
FIG. 1 is a perspective view of a turbine airfoil having features according to the invention.
Figure 2:
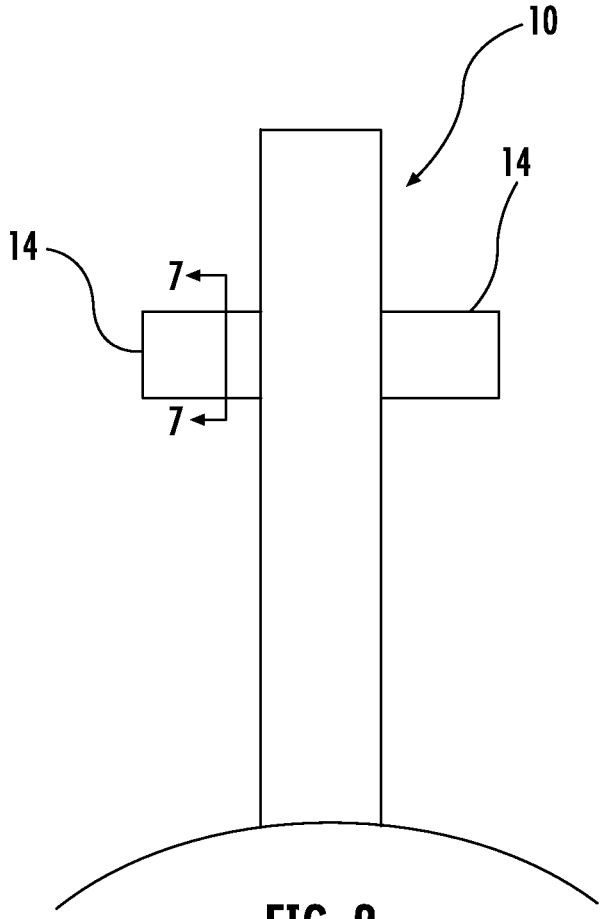
FIG. 2 is a schematic diagram of a front of one of the turbine airfoils shown in FIG. 1.
Figure 3:
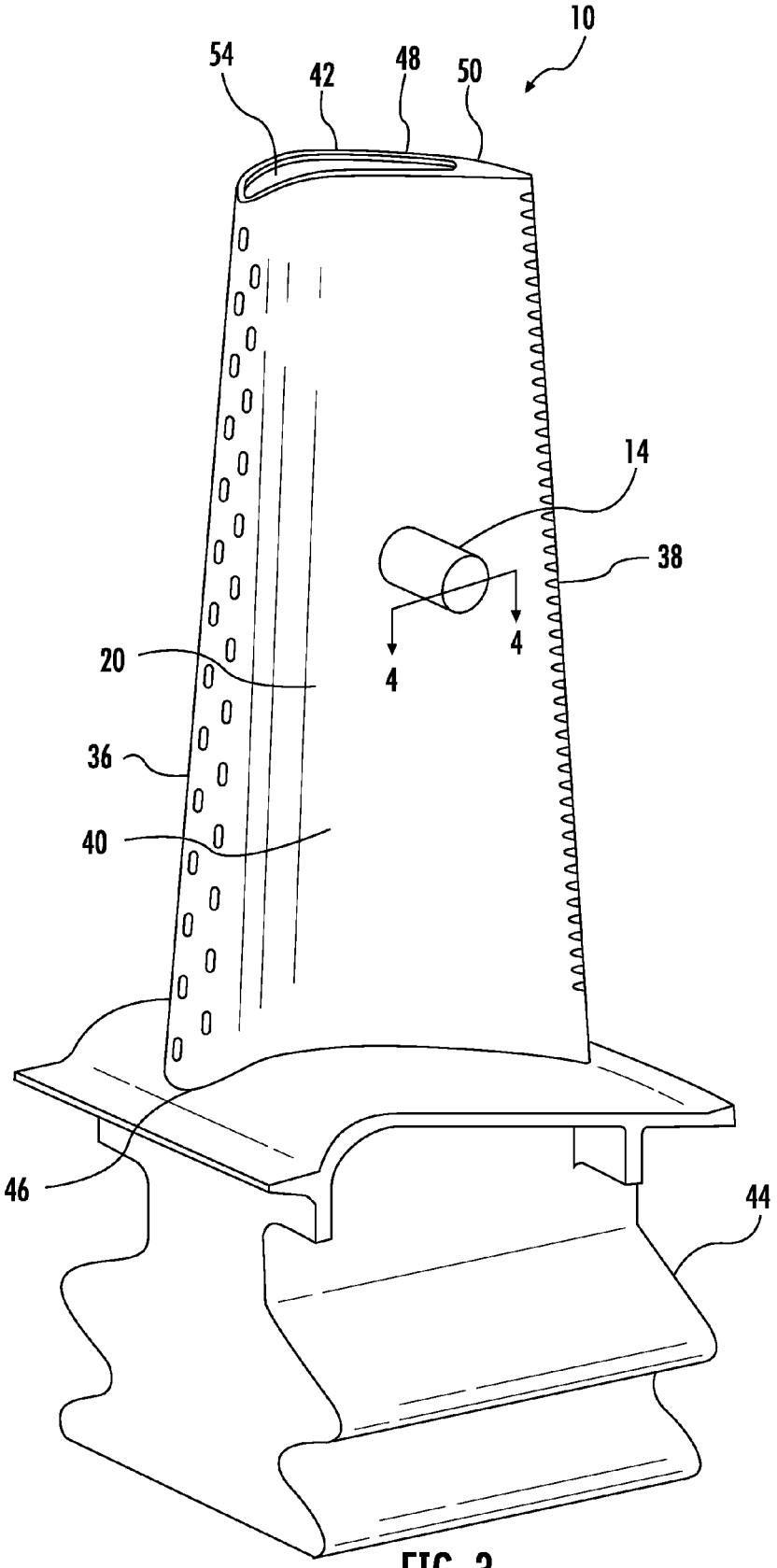
FIG. 3 is a perspective view of the turbine airfoil shown in FIG. 2.

As shown in FIGS. 2 and 3, the turbine airfoil 10 may have any appropriate configuration. In at least one embodiment, the turbine airfoil 10 may have a generally elongated hollow airfoil 54 formed from an outer housing 20, and may have a leading edge 36, a trailing edge 38, a pressure side 40, a suction side 42, a root 44 at a first end 46 of the airfoil 10 and a tip 48 at a second end 50 opposite to the first end 46, and an airfoil cooling system 18 positioned within interior aspects of the generally elongated hollow airfoil 10. The turbine airfoil 10 may include a snubber 14 extending from the outer housing 20 forming the generally elongated hollow airfoil 54 toward an adjacent turbine airfoil 56 positioned within a row 58 of airfoils 10 including the generally elongated hollow airfoil 54, as shown in FIG. 1. The turbine airfoil 10 may also include a snubber cooling system 16 positioned within the snubber 14 and formed from one or more inner cooling channels 22 separated from one or more outer cooling channels 24 by an inner wall 26. The inner cooling channel 22 may be in fluid communication with the airfoil cooling system 18 via an inlet 60 to receive cooling fluid from the airfoil cooling system 18 within the generally elongated hollow airfoil 54. The inlet 60 may have any appropriate configuration and may have a cross-sectional area that is smaller than a cross-sectional area for the inner cooling channel 22. In other embodiments, the inlet 60 may have another size relationship to the inner cooling channel 22. The inner wall 26 may include one or more impingement cooling orifices 28 positioned to allow cooling fluid to pass from the inner cooling channel 22 and impinge on an inner surface 62 of an outer wall 30 forming the outer cooling channel 24.

Figure 5:
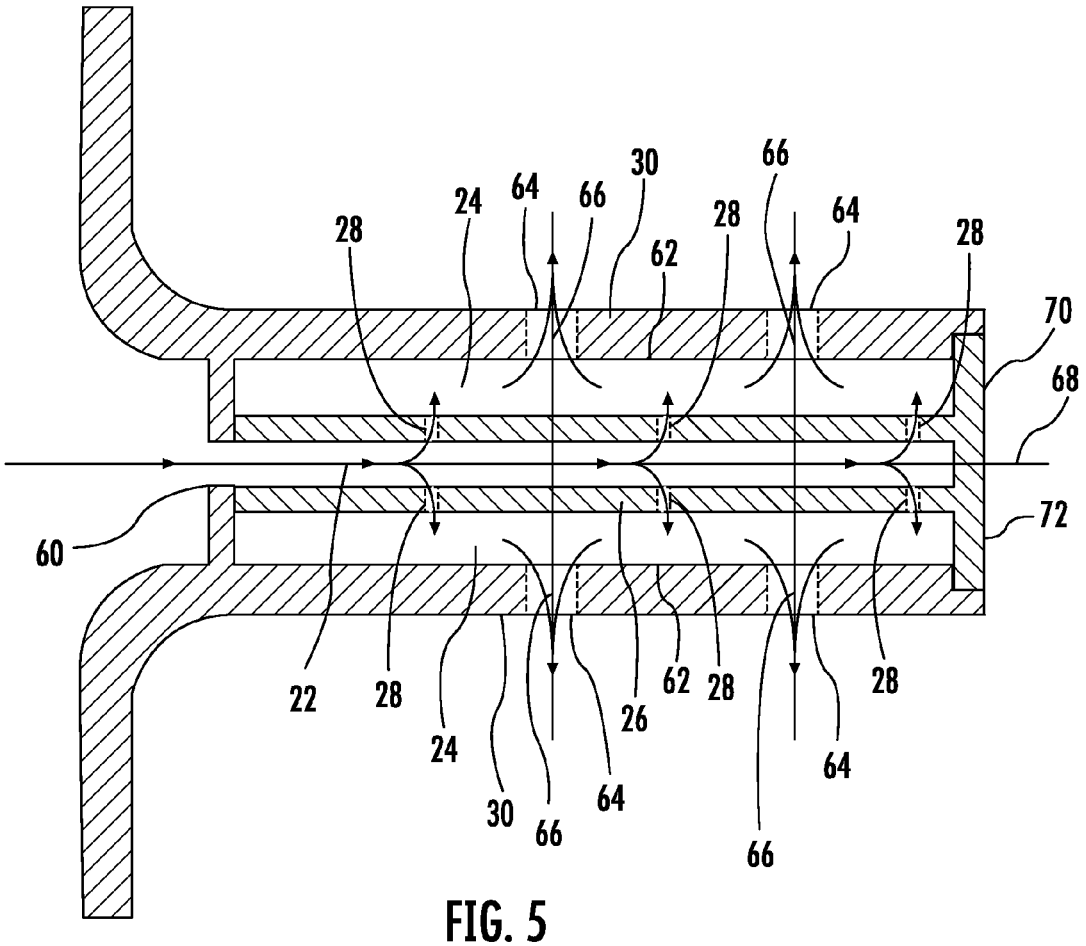
FIG. 5 is a cross-sectional view of the snubber extending outwardly from the turbine airfoil and showing a snubber cooling system with exhaust orifices, taken at section line 4-4 in FIG. 3.

In at least one embodiment, as shown in FIG. 5, the outer wall 30 forming the outer cooling channel 24 may include one or more cooling fluid discharge orifices 64 for discharging cooling fluid. The cooling fluid discharge orifices 64 may have any appropriate shape and orientation. The cooling fluid discharge orifices 64 may also be positioned in any appropriate pattern to facilitate desired cooling of the snubber 14. In at least one embodiment, the airfoil 10 may include a plurality of cooling fluid discharge orifices 64 aligned in rows 66 separated laterally along a longitudinal axis 68 of the snubber 14 and positioned circumferentially about the longitudinal axis 68.

Figure 4:
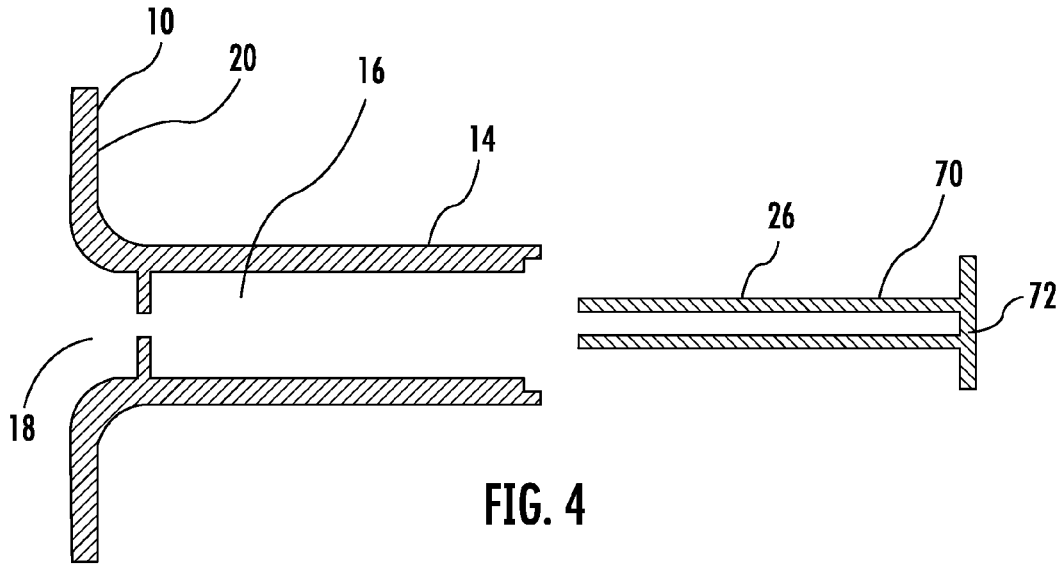
FIG. 4 is an exploded cross-sectional view of a snubber extending outwardly from the turbine airfoil, taken at section line 4-4 in FIG. 3.

As shown in FIGS. 4 and 5, the inner wall 26 may be formed from an insert 70 positioned within the outer wall 30. The inner wall 26 may include an end cap 72 that is sealed to the outer wall 30 to enclose the snubber cooling system 16. The inner wall 26 may also be formed from any appropriate manufacturing technique into an insert, a cast in feature and the like. The inner and outer walls 26, 30 may be cylindrical. In another embodiment, the inner and outer walls 26, 30 may be elliptical or have another shape. The inner wall 26 may be positioned concentrically within the outer wall 30. The outer wall 30 may be formed integrally with the outer housing 20 forming the generally elongated hollow airfoil 54.

In another embodiment, as shown in FIGS. 6 and 7, the snubber cooling system 30 may exhaust cooling fluid, after passing through the snubber 14, back into the airfoil cooling system 18. The cooling fluid is routed in such a configuration via a cooling fluid exhaust channel 74 formed from an exhaust wall 76 positioned within the snubber cooling system 30 and having an outlet 78 in fluid communication with the airfoil cooling system 18. A cooling fluid manifold 80 may be positioned between the outer cooling channel 24 and the cooling fluid exhaust channel 74. The cooling fluid manifold 80 may be positioned at an inner surface 82 of the end cap 72. The cooling fluid exhaust channel 74 may be positioned within the inner cooling channel 22. In at least one embodiment, the exhaust, inner and outer walls 76, 26, 30 may be cylindrical. The inner wall 26 may be positioned concentrically within the outer wall 30, and the exhaust wall 76 may be positioned concentrically within the inner wall 26. The inner wall 26 and the exhaust wall 76 may be formed from an insert 70 positioned within the outer wall 30. In other embodiments, the inner wall 26 may be formed from any appropriate manufacturing technique into an insert, a cast in feature and the like. The insert 70 may include an end cap 72 that is sealed to the outer wall 30 to enclose the snubber cooling system 16.

The snubber cooling system 30 may also include a plurality of flow guides 32, as shown in FIG. 8, extending radially outward from the inner wall 26 into the outer cooling channel 24. The impingement cooling orifice 28 in the inner wall 26 may be positioned between two flow guides 32 and exhaust orifices 86 in an end wall 88 leading to the cooling fluid manifold 80 are circumferentially offset, one each direction, from a mini-chamber 90 created by the two flow guides 32 so that impingement cooling fluid exhausted through the impingement cooling orifice 28 must pass one of the flow guides 32, as shown in FIG. 8, to exit from the outer cooling channel 24 through the exhaust orifices 86, thereby reducing cross-flow across downstream impingement cooling orifices 28. In at least one embodiment, one or more of the flow guides 32 may extend the full length of the outer cooling channel 24. In other embodiments, one or more of the flow guides 32 may extend for a partial length of the outer cooling channel 24. The flow guides 32 may have a cross-section with a square shape, rectangular shape or other appropriate configuration.

During use, the cooling fluids may be passed from the airfoil cooling system 18 via the inlet 60 to the inner cooling channel 22. The cooling fluid may flow through the inner cooling channel 22 and pass through one or more impingement cooling orifices 28 in the inner wall 26 forming the inner cooling channel 22. The cooling fluid passing through the impingement cooling orifices 28 may impinge on the inner surface 62 of the outer wall 30. In one embodiment shown in FIG. 5, the cooling fluid may be exhausted from the snubber 14 via cooling fluid discharge orifices 64. In another embodiment, shown in FIG. 6, the cooling fluid may be passed from the outer cooling channel 24 into the cooling fluid manifold 80. The cooling fluid may be collected in the cooling fluid manifold 80 and passed into the cooling fluid exhaust channel 74. The cooling fluid may pass through the cooling fluid exhaust channel 74 and may be exhausted back to the airfoil cooling system 18 via the outlet 78.

In another embodiment, as shown in FIG. 8, the cooling fluid in the inner cooling channel 22 may be passed through the impingement cooling orifices 28 and may impinge on the inner surface 62 of the outer wall 30 where the cooling fluid is in the outer cooling channel 24. The flow guides 32 may be aligned with the longitudinal axis 68 of the snubber 14 and may extend radially outward from the inner wall 26. In other embodiments, the flow guides 32 may be positioned diagonally, circumferentially or an another position. The flow guides 32 may be positioned between the impingement cooling orifices 28 and the exhaust orifices 86 such that cooling fluid must first pass from the mini-chamber 90 formed by the flow guides 32, over the flow guides 32 and through the exhaust orifices 86. Flowing circumferentially out of the mini-chambers 90 reduces the amount of cross-flow that the downstream impingement cooling orifices 28 experience. After the cooling fluid flows through the exhaust orifices 86, the cooling fluid collects in the cooling fluid manifold 80 and may be passed into the cooling fluid exhaust channel 74. The cooling fluid may pass through the cooling fluid exhaust channel 74 and may be exhausted back to the airfoil cooling system 18 via the outlet 78.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A turbine airfoil, comprising:

a generally elongated hollow airfoil formed from an outer housing, and having a leading edge, a trailing edge, a pressure side, a suction side, a root at a first end of the airfoil and a tip at a second end opposite to the first end, and an airfoil cooling system positioned within interior aspects of the generally elongated hollow airfoil;

a snubber extending from the outer housing forming the generally elongated hollow airfoil toward an adjacent turbine airfoil positioned within a row of airfoils including the generally elongated hollow airfoil; and a snubber cooling system positioned within the snubber and formed from at least one inner cooling channel separated from at least one outer cooling channel by an inner wall, wherein the at least one inner cooling channel is in fluid communication with the airfoil cooling system via an inlet to receive cooling fluid from the airfoil cooling system within the generally elongated hollow airfoil and wherein the inner wall includes at least one impingement cooling orifice positioned to allow cooling fluid to pass from the at least one inner cooling channel and impinge on an inner surface of an outer wall forming the at least one outer cooling channel.

2. The turbine airfoil of claim 1, wherein the inner wall is formed from an insert positioned within the outer wall and wherein the inner wall includes an end cap that is sealed to the outer wall to enclose the snubber cooling system.

3. The turbine airfoil of claim 1, wherein the inner and outer walls are cylindrical, and the inner wall is positioned concentrically within the outer wall.

4. The turbine airfoil of claim 1, wherein the outer wall forming the at least one outer cooling channel includes at least one cooling fluid discharge orifice for discharging cooling fluid.

5. The turbine airfoil of claim 4, wherein the at least one cooling fluid discharge orifice comprises a plurality of cooling fluid discharge orifices aligned in rows separated laterally along a longitudinal axis of the snubber.

6. The turbine airfoil of claim 1, further comprising a cooling fluid exhaust channel formed from an exhaust wall positioned within the snubber cooling system and having an outlet in fluid communication with the airfoil cooling system.

7. The turbine airfoil of claim 6, wherein the inner wall and the exhaust wall are formed from an insert positioned within the outer wall, and wherein the insert includes an end cap that is sealed to the outer wall to enclose the snubber cooling system.

8. The turbine airfoil of claim 6, further comprising a plurality of flow guides extending radially outward from the inner wall into the at least one outer cooling channel.

9. The turbine airfoil of claim 8, wherein the at least one impingement cooling orifice in the inner wall is positioned between two flow guides and exhaust orifices in an end wall leading to a cooling fluid manifold are circumferentially offset, one each direction, from a mini-chamber created by the two flow guides so that impingement cooling fluid exhausted through the at least one impingement cooling orifice must pass one of the flow guides to exit from the at least one outer cooling channel through the exhaust orifices, thereby reducing cross-flow across downstream impingement cooling orifices.

10. The turbine airfoil of claim 6, further comprising a cooling fluid manifold positioned between the at least one outer cooling channel and the cooling fluid exhaust channel.

11. The turbine airfoil of claim 10, wherein the cooling fluid manifold is positioned at an inner surface of an end cap.

12. A turbine airfoil, comprising:

a generally elongated hollow airfoil formed from an outer housing, and having a leading edge, a trailing edge, a pressure side, a suction side, a root at a first end of the airfoil and a tip at a second end opposite to the first end, and an airfoil cooling system positioned within interior aspects of the generally elongated hollow airfoil;

a snubber extending from the outer housing forming the generally elongated hollow airfoil toward an adjacent turbine airfoil positioned within a row of airfoils including the generally elongated hollow airfoil;

a snubber cooling system positioned within the snubber and formed from at least one inner cooling channel separated from at least one outer cooling channel by an inner wall, wherein the at least one inner cooling channel is in fluid communication with the airfoil cooling system via an inlet to receive cooling fluid from the airfoil cooling system within the generally elongated hollow airfoil and wherein the inner wall includes at least one impingement cooling orifice positioned to allow cooling fluid to pass from the at least one inner cooling channel and impinge on an inner surface of an outer wall forming the at least one outer cooling channel; and a cooling fluid exhaust channel formed from an exhaust wall positioned within the snubber cooling system and having an outlet in fluid communication with the airfoil cooling system, wherein the cooling fluid exhaust channel is positioned within the at least one inner cooling channel.

13. The turbine airfoil of claim 12, further comprising a cooling fluid manifold positioned between the at least one outer cooling channel and the cooling fluid exhaust channel and wherein the cooling fluid manifold is positioned at an inner surface of an end cap.

14. The turbine airfoil of claim 12, wherein the exhaust, inner and outer walls are cylindrical, and the inner wall is positioned concentrically within the outer wall and the exhaust wall is positioned concentrically within the at least one inner wall.

15. The turbine airfoil of claim 12, wherein the inner wall and the exhaust wall are formed from an insert positioned within the outer wall, and wherein the insert includes an end cap that is sealed to the outer wall to enclose the snubber cooling system.

16. The turbine airfoil of claim 12, further comprising a plurality of flow guides extending outward from the inner wall into the at least one outer cooling channel.

17. The turbine airfoil of claim 16, wherein the at least one impingement cooling orifice in the inner wall is positioned between two flow guides and exhaust orifices in an end wall leading to a cooling fluid manifold are circumferentially offset, one each direction, from a mini-chamber created by the two flow guides so that impingement cooling fluid exhausted through the at least one impingement cooling orifice must pass one of the flow guides to exit from the at least one outer cooling channel through the exhaust orifices, thereby reducing cross-flow across downstream impingement cooling orifices.

18. A turbine airfoil, comprising:

a generally elongated hollow airfoil formed from an outer housing, and having a leading edge, a trailing edge, a pressure side, a suction side, a root at a first end of the airfoil and a tip at a second end opposite to the first end, and an airfoil cooling system positioned within interior aspects of the generally elongated hollow airfoil;

a snubber extending from the outer housing forming the generally elongated hollow airfoil toward an adjacent turbine airfoil positioned within a row of airfoils including the generally elongated hollow airfoil;

a snubber cooling system positioned within the snubber and formed from at least one inner cooling channel separated from at least one outer cooling channel by an inner wall, wherein the at least one inner cooling channel is in fluid communication with the airfoil cooling system via an inlet to receive cooling fluid from the airfoil cooling system within the generally elongated hollow airfoil and wherein the inner wall includes at least one impingement cooling orifice positioned to allow cooling fluid to pass from the at least one inner cooling channel and impinge on an inner surface of an outer wall forming the at least one outer cooling channel;

a cooling fluid exhaust channel formed from an exhaust wall positioned within the snubber cooling system and having an outlet in fluid communication with the airfoil cooling system, wherein the cooling fluid exhaust channel is positioned within the at least one inner cooling channel;

a plurality of flow guides extending radially outward from the inner wall into the at least one outer cooling channel;

wherein the at least one impingement cooling orifice in the inner wall is positioned between two flow guides and exhaust orifices in an end wall leading to a cooling fluid manifold are circumferentially offset, one each direction, from a mini-chamber created by the two flow guides so that impingement cooling fluid exhausted through the at least one impingement cooling orifice must pass one of the flow guides to exit from the at least one outer cooling channel through the exhaust orifices, thereby reducing cross-flow across downstream impingement cooling orifices; and wherein the inner wall and the exhaust wall are formed from an insert positioned within the outer wall, and wherein the insert includes an end cap that is sealed to the outer wall to enclose the snubber cooling system.

* * * * *